US006151932A

United States Patent [19]

Molto et al.

[11] Patent Number: 6,151,932

[45] Date of Patent: Nov. 28, 2000

[54] DRUM FOR TREATING LEATHER, FUR AND SIMILAR PRODUCTS

[76] Inventors: Concepción Julia Molto; Asunción Marin Guerrero, both of Carretera de Caravaca, 56, 30814 Lorcia, Murcia, Spain

[21] Appl. No.: 09/356,772

[22] Filed: Jul. 16, 1999

[30] Foreign Application Priority Data

Jul. 21, 1998 [ES] Spain ..... 9801947

[51] Int. Cl.[7] ..... C14C 15/00

[52] U.S. Cl. ..... 69/30; 68/144; 366/228

[58] Field of Search ..... 69/29, 30, 31, 69/32; 68/142, 144; 134/120; 366/228

[56] References Cited

U.S. PATENT DOCUMENTS

| | | | |
|---|---|---|---|
| 623,368 | 4/1899 | Whiting et al. | 68/144 |
| 1,338,307 | 4/1920 | Krouse | 69/30 |
| 1,760,796 | 5/1930 | Szmukler | 69/30 |
| 3,474,647 | 10/1969 | Dandliker | 69/30 |
| 4,480,922 | 11/1984 | Mendenhall | 366/25 |

*Primary Examiner*—Michael A. Neas
*Attorney, Agent, or Firm*—Darby & Darby

[57] ABSTRACT

A drum to be used in the treatment of hides and leathers is fitted with a number of bats, the arrangement of the bats being determined by an imaginary polygon having an even number of vertices. A pair of bats, parallel to each other, are placed at opposite vertices of the imaginary polygon.

1 Claim, 1 Drawing Sheet

DRUM FOR TREATING LEATHER, FUR AND SIMILAR PRODUCTS

OBJECT OF THE INVENTION

The present invention refers to a drum for machines used in the treatment of skins and similar products, so devised as to ensure greater efficiency in the treatment of skins and leathers, based on a particular arrangement of the stirring bats fitted inside the drum.

The object of the invention is to provide a drum in which the skins and leathers may be subjected to stirring by the revolving action of the water-filled drum, with improved performance and efficiency in the treatment process, as well as a number of advantages relative to conventional drums used for the same purposes

BACKGROUND ON THE INVENTION

In the tanning industry, the treatment or tanning of furs, leathers and similar products is carried out by stirring such items in a revolving drum containing a bath of water and chemicals, such that the chemicals are absorbed into the hides and a number of waste products are extracted from them. The water must be subsequently treated to eliminate such waste products and chemicals.

To perform the stirring of the hides or leathers in the drum, the latter is fitted with a number of bats and/or rods, affixed radially, in a longitudinal arrangement, to the drum's inner surface, such that a mechanical effect is generated by the centrifugal force arising from the turning of the drum.

However, the movement of the liquid contained in the drum is virtually nil, which entails a very low efficiency level in the treatment process, as well as a high energy and water consumption, to which must be added the high cost of treating the waste water, given the large amounts of water used.

DESCRIPTION OF THE INVENTION

The drum under reference has been devised to solve the aforesaid problems in a fully satisfactory manner, by means of a simple and effective solution based on a specific arrangement of the inner bats, whose number ranges between two (2) and six (6), according to the size of the drum, which bats perform the stirring operation.

Specifically, the bats fitted onto the drum involved in the present invention are perpendicular to the drum heads (end faces) but, instead of being radial, they are somewhat displaced from the radius, although still parallel to it, positioned in principle at the vertices of an imaginary polygon, concentric to said drum.

The incorporation of these bats-Scoops to the drum, replacing the bats and/or rods, leads to a number of advantages relative to conventional drums fitted with bats or rods, which may be summarised as follows:

Considerable energy saving in the actual hide and/or leather soaking, hair removal and tanning process, with an estimated 60% reduction in energy consumption.

A great saving in water used in the treatment process, estimated at approximately 50% relative to the volume required by such a process using conventional drums.

Increased production capacity, estimated eat 50% higher than for conventional drums.

Reduction in the cost of the overall process, taking into account the aforesaid savings.

Lower cost of waste water treatment (bath water requiring treatment) which may likewise be estimated at 50% relative to the cost associated with conventional drums.

Obviously, the drum referred to in the present invention may be of any dimensions whatsoever: the number of Scoops and their height may vary, depending on the processes that the drum is intended for. In any case, the height of the Scoops may vary between 600 mm and 1,500 mm, and they must be fitted to the drum heads.

In addition, by adding a transverse heel of variable width at the upper end of the scoops, we may increase their load capacity.

Rotation may be in one or two directions, ranging between 0.25 r.p.m. and 8 r.p.m.

It should also be stressed that the mechanical effect is produced by the skins themselves, by the action of gravity, as opposed to what occurs in conventional drums, where the mechanical effect is produced by the actual drum by centrifugal force.

Also worth noting is the fact that the movement of the skins in the drum of the present invention is achieved by means of large Scoops, as opposed to conventional drums, where the movement of the skins is performed by means of the usual bats and/or rods.

Another feature of major importance is that in the drum of the present invention, there is total movement of the water or bath, while in conventional drums the movement of the bath is virtually nil.

DESCRIPTION OF THE DRAWINGS

With the aim of completing the present description, and in order to ensure a clearer understanding of the features of the invention, according to a preferred embodiment of same, there is attached, as an integral part of said description, a set of drawings showing the following, on an illustrative but not a restrictive basis.

PREFERRED EMBODIMENT OF THE INVENTION

Figure 1:
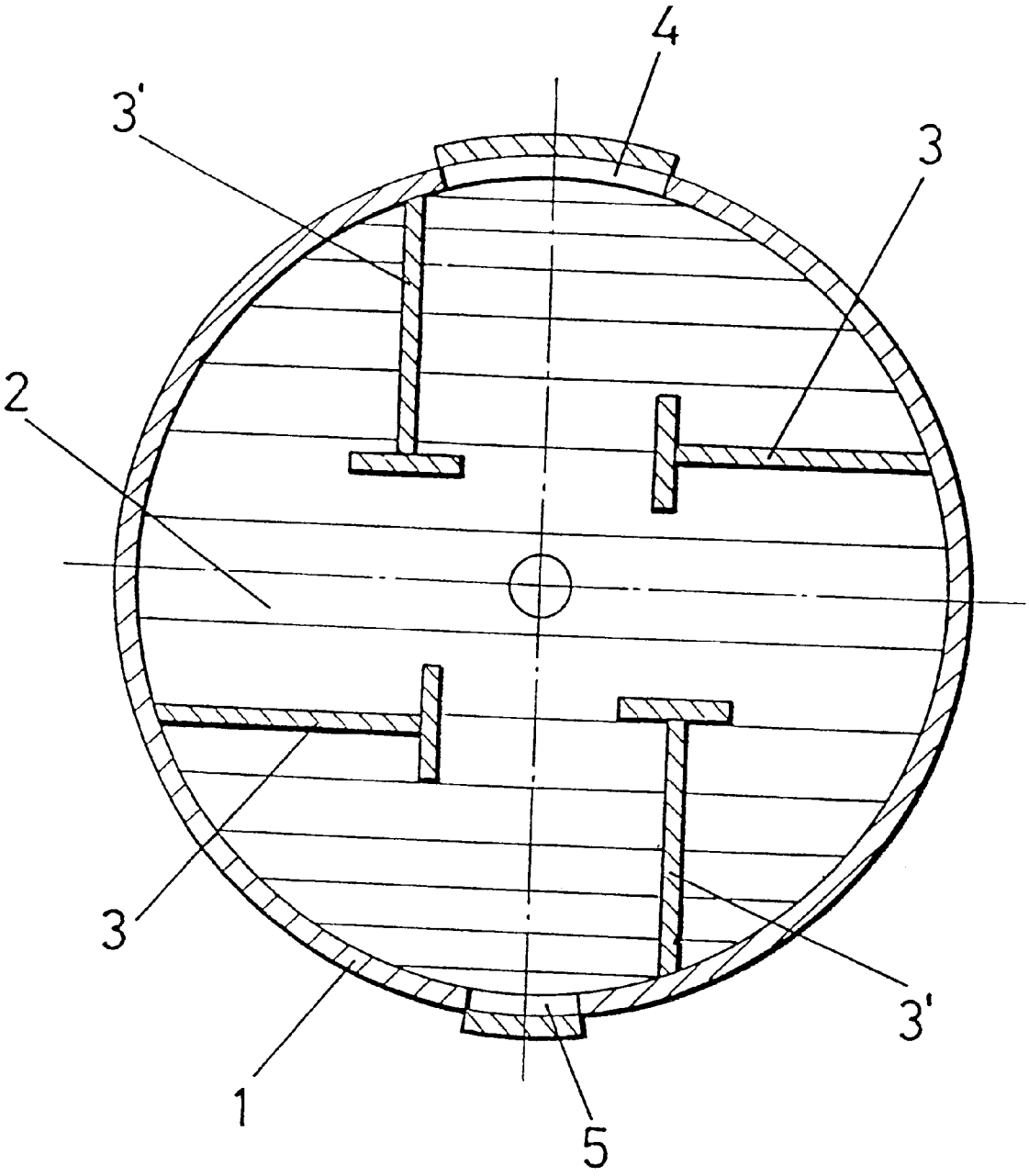
FIG. 1:—Shows a cross-sectional view of a drum fitted, in this case, by way of an example, with four (4) scoop bats, constructed in accordance with the object of the invention; we may observe the arrangement of the scoops and transverse heels.

As shown in the aforesaid figures, the drum (1) of the present invention is comprised, following the conventional design, of a cylindrical body with its sides or heads (2) suitably closed, with the particular feature that the inside of the cylindrical body making up the drum (1) is fitted with the scoops (3–3'), positioned in this case, by way of an example, involving a four scoop drum, at the vertices of an imaginary four-sided polygon concentric with the drum itself, such that said scoops are equidistant from each other and oriented so that the Scoops (3) located at diametrically opposed points are parallel to each other, while the two other Scoops (3'), also at two diametrically opposed points, are also parallel to each other, although each pair of scoops is perpendicular to the other; i.e., the two Scoops (3) are perpendicular to the other two Scoops (3').

As is the usual case, the drum also features a loading hatch (4) and an inspection hatch (5). The heels may be seen at the upper end of each scoop.

It is not considered necessary to extend the present description any further in order that any expert on the matter may understand the scope of the invention and the advantages arising from same.

The materials, shape, size and arrangement of the constituent elements are subject to modifications, provided that this does not involve an alteration of the essential features of the invention.

The present description should always be interpreted in a broad sense, without any restrictive intent.

What is claimed is:

1. A drum for machines used in the treatment of hides or leathers, comprised of a cylindrical body with closed bases, featuring an opening for loading and another for draining off the water used in the stirring of the hides or leathers introduced into the drum, and including a number of bats fitted to the inside of the drum, characterised by the fact that the actual bats are arranged perpendicular to those beside them and positioned at the vertices of an imaginary square concentric to the drum itself, such that two bats located at diametrically opposed points will be parallel to each other and in turn perpendicular to the other two bats, located at another two points likewise diametrically opposed, such that the second pair of bats are also parallel to each other.

* * * * *